US009681711B2

(12) United States Patent
Monard

(10) Patent No.: US 9,681,711 B2
(45) Date of Patent: Jun. 20, 2017

(54) ADJUSTABLE BRACELET

(71) Applicant: Fossil Group, Inc., Richardson, TX (US)

(72) Inventor: Matthieu Monard, La Chaux-de-Fonds (CH)

(73) Assignee: Fossil Group, Inc., Richardson, TX (US)

( * ) Notice: Subject to any disclaimer, the term of this patent is extended or adjusted under 35 U.S.C. 154(b) by 68 days.

(21) Appl. No.: 14/724,463

(22) Filed: May 28, 2015

(65) Prior Publication Data

US 2016/0345691 A1 Dec. 1, 2016

(51) Int. Cl.
*A44C 5/04* (2006.01)
*G04B 37/00* (2006.01)
*A44C 5/24* (2006.01)

(52) U.S. Cl.
CPC ..... *A44C 5/04* (2013.01); *A44C 5/246* (2013.01); *G04B 37/0008* (2013.01)

(58) Field of Classification Search
CPC ..... A44C 5/04; A44C 5/246; A44C 5/185; A44C 5/02; A44C 5/105; A44C 5/027; G04B 37/0008; Y10T 24/2155; Y10T 24/4782
USPC ..... 24/265 WS
See application file for complete search history.

(56) References Cited

U.S. PATENT DOCUMENTS 1,756,769 A * 4/1930 Tost ..... A44C 5/24 24/71 J
5,749,128 A * 5/1998 Cuche ..... A44C 5/246 24/265 WS
5,771,543 A * 6/1998 Froidevaux ..... A44C 5/246 24/265 WS
6,185,799 B1 * 2/2001 Gay ..... A44C 5/24 24/715
7,571,519 B2 * 8/2009 Sierro ..... A44C 5/185 24/265 WS
8,001,658 B2 * 8/2011 Christian ..... A44C 5/246 24/265 WS
2008/0083101 A1 4/2008 Christian et al.
2010/0302914 A1 * 12/2010 Faucher ..... A44C 5/147 368/282
2013/0160255 A1 * 6/2013 Schmidt ..... A44C 5/14 24/71 J (Continued)

FOREIGN PATENT DOCUMENTS

JP S49 126066 U 10/1974

*Primary Examiner* — Robert J Sandy
*Assistant Examiner* — Rowland Do
(74) *Attorney, Agent, or Firm* — Kirby B. Drake; Klemchuk LLP

(57) ABSTRACT

A bracelet may be adjustable. The bracelet may be a portion of a watch and/or jewelry. The bracelet may include a clasp with a track that includes a plurality of first openings and second openings. A first end of the bracelet may include a link with a pin. The pin may be disposed in the track, and the length of the bracelet may be adjusted by moving the pin along a length of the track. The pin may have a length and a cross-sectional shape perpendicular to the length. The cross-sectional shape may allow the pin to travel along the length of the track when the link is disposed at an angle relative to the length of the track and may restrict the pin from travelling along the length of the track when the link is approximately parallel to the length of the track.

15 Claims, 5 Drawing Sheets

(56) References Cited

U.S. PATENT DOCUMENTS

| | | | | |
|---|---|---|---|---|
| 2013/0286797 | A1* | 10/2013 | Leger | A44C 5/246<br>368/282 |
| 2014/0223705 | A1* | 8/2014 | Catanese | A44C 5/24<br>24/71 J |

* cited by examiner

ADJUSTABLE BRACELET

TECHNICAL FIELD

The present disclosure relates to adjustable bracelets.

BACKGROUND

Bracelets are often used in watches and jewelry. For link-style bracelets, links in the bracelet may be removed to adjust the fit. However, wearers may find that removal of one link may cause the bracelet to be too loose, while removal of two links may cause the bracelet to be too tight. Removal of links or shortening of the bracelet length may require special tools or the assistance of a jeweler. Often wearers may find the fit of the bracelet to vary during summer versus winter, such that a bracelet that was comfortable during one season may be too tight in the summer or too loose in the winter.

SUMMARY

Embodiments of the present disclosure may provide a watch comprising a watch case comprising a movement; a bracelet coupled to the watch case, the bracelet comprising: a clasp coupled proximate a first end of the bracelet, wherein the clasp comprises: a track comprising an opening disposed in a member of the clasp, wherein the opening comprises a set of first opening sections coupled together by a set of second opening sections, wherein a height of the second opening sections is less than a height of the first opening sections; and a link coupled proximate a second end of the bracelet, wherein the link comprises a pin, and wherein the pin comprises: a length; and a cross-section perpendicular to the length, wherein the cross-section of the pin comprises a width and a height, and wherein the width of the cross-section is less than the height of the cross-section; wherein the pin of the link is disposed in the track, and wherein the link is rotatable when the pin is disposed in one of the first openings; and wherein the link is restricted from rotating when the pin is disposed in one of the second openings; and wherein a length of the bracelet is adjustable by allowing the pin of the link to travel along a length of the track, wherein the pin is restricted from travel along the length of the track when the link is approximately parallel to the track. The link may comprise an H-link. The watch may further comprise at least two spring loaded buttons, wherein at least two of the buttons are disposed on opposing sides of the link, and wherein the buttons are adapted to allow frictional retention of the link in a cover of the clasp when the link is approximately parallel to the track. The cross-section may comprise a curved section and a straight section. The clasp may comprise at least two articulating members comprising: a first articulating member; and a second articulating member; wherein a first end of the second articulating member may be coupled to a first end of the first articulating member, and a second end of the first articulating member may be coupled to a second end of the bracelet, and wherein the second end of the second articulating member may be coupled to the cover of the clasp. The watch may further comprise a lock, wherein the lock may be adapted to retain the clasp in a closed position when coupled to a cover of the clasp. The bracelet may comprise a first part comprising: a first end comprising the first end of the bracelet; and a second end coupled to a first end of the watch case; and a second part comprising: a first end comprising the second end of the bracelet; and a second end coupled to a second end of the watch case opposite to the first end of the watch case. The bracelet may comprise one or more removable links.

Other embodiments of the present disclosure may provide a method of adjusting a bracelet, the method comprising: allowing a link of a bracelet to rotate from a first position approximately parallel to a track of a clasp to a second position at a predetermined range of angles to the track; and wherein rotation of the link may rotate a pin of the link disposed in the track, and wherein the track may be a single opening disposed in a member of the clasp, and wherein the track comprises first opening sections and second opening sections; and adjusting the length of the bracelet by allowing the pin to travel along a length of the track; and selecting a length of the bracelet by positioning the pin in at least one of the first opening sections of the track and rotating the link to the first position. Allowing the pin to travel along the length of the track may include allowing the pin to travel through at least one of the second opening sections of the track. Selecting a length of the bracelet may include allowing one or more spring-loaded buttons disposed in opposing sides of the link to be frictionally retained in a cover of the clasp. The pin may be restricted from traveling along a length of the track when the link is not in the second position. The link may be restricted from rotating when the link is in the second position and the pin is in at least one of the second opening sections.

Further embodiments of the present disclosure may provide a bracelet comprising a clasp coupled proximate a first end of a bracelet, wherein the clasp comprises: a track, wherein the track comprises an opening disposed in a member of the clasp, wherein the opening comprises a set of first openings coupled together by a set of second openings, wherein the height of the second openings is less than the height of the first openings; a link coupled proximate a second end of the bracelet, wherein the link comprises a pin, and wherein the pin comprises: a length; and a cross-sectional shape perpendicular to the length, and wherein the cross-sectional shape of the pin comprises a width and a height, and wherein the width of the cross-sectional shape is less than the height of the cross-sectional shape; wherein the pin of the link may be disposed in the track, and wherein the link is rotatable when the pin may be disposed in one of the first openings; and wherein the link is restricted from rotating when the pin may be disposed in one of the second openings; and wherein a length of the bracelet may be adjusted by allowing the pin to travel along a length of a track, and wherein a length of the bracelet may be restricted from adjusting when the link is approximately parallel to the length of the track. The cross-sectional shape may comprise a curved section and a straight section. The pin may be retained in the track. The bracelet may be adapted to couple to a watch case. The bracelet may further comprise at least two spring-loaded buttons, wherein at least two of the buttons are disposed on opposing sides of the link, and wherein the buttons may be adapted to allow frictional retention of the link in a cover of the clasp when the link is approximately parallel to the track. The bracelet may comprise a second end, and wherein the clasp may comprise at least two articulating members comprising: a first arm; and a second arm; wherein a first end of the second arm may be coupled to a first end of the first arm, and a second end of the first arm may be coupled to a second end of the bracelet, and wherein the second end of the second arm may be coupled to a cover of the clasp. The bracelet may further comprise a lock adapted to retain the clasp in a closed position.

In various implementations, an adjustable bracelet may be provided. The adjustable bracelet may form part of a watch and/or jewelry, such as bracelets, rings, and/or other types of jewelry. The bracelet may wrap around a wearer's wrist, in some implementations. The bracelet may be secured using a clasp.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Figure 1A:
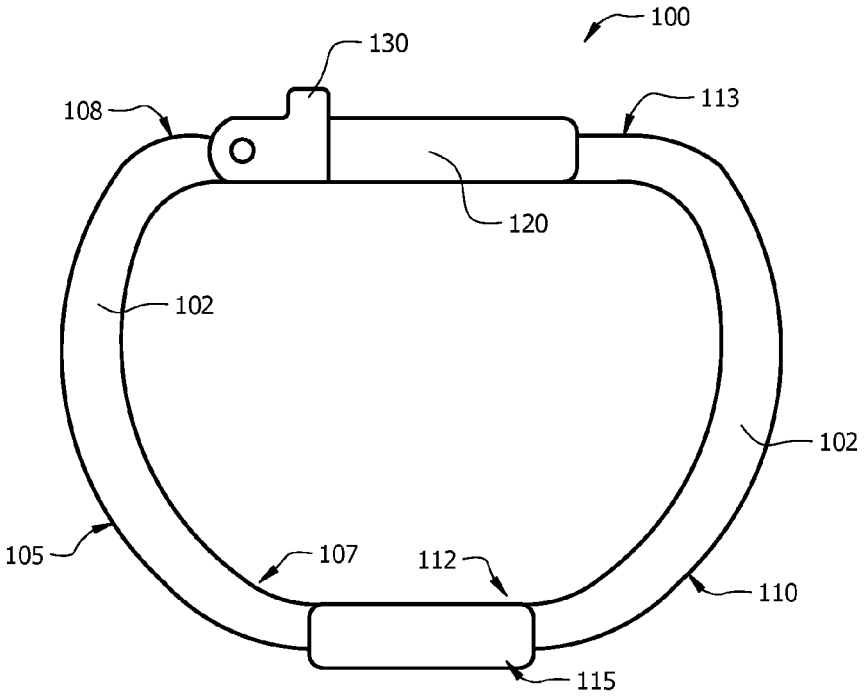
FIG. 1A illustrates a side view of an implementation of a watch according to an embodiment of the present disclosure.

In various implementations, a bracelet may be adjustable. Adjusting a bracelet may increase a wearer's enjoyment by providing a more comfortable, secure and/or styled fit. In some implementations, the bracelet may be adjusted and/or readjusted by a user. The bracelet may be a portion of a watch and/or jewelry. For example, watches may include bracelets. Jewelry, such as bangles (e.g., rigid and/or flexible) and/or cuffs, may also include bracelets. The bracelet may wrap at least partially around a portion of a wearer's body, such as a wrist.

The bracelet of a watch may be adjustable and/or readjustable to allow the bracelet to be sized to a wearer's specifications. Thus, if a watchband is too tight, the bracelet may be adjusted to increase the length of the bracelet of the watch. If a watchband is too loose, the bracelet may be adjusted to decrease the length of the bracelet of the watch. Adjusting the watch may not require special tools and/or may not require the assistance of a jeweler, in various implementations. By allowing a user to easily adjust and/or readjust a length of a bracelet, adjustments due to seasons (e.g., change in wrist size in the summer as compared to winter), style changes (e.g., tighter fit when worn under a jacket sleeve), and/or wearer changes (e.g., borrowing another wearer's watch or jewelry), the wearer's enjoyment and/or the functionality of the watch and/or jewelry may be increased.

In some implementations, adjusting a length of a bracelet using a track may allow smaller adjustments in length (e.g., when compared to the removal of bracelet links). Thus, a wearer may utilize the track to make more refined adjustments to the length of a bracelet.

In various implementations, a bracelet length may be adjusted using a track disposed in a clasp of the bracelet. A first end of the bracelet may include a link with a pin. The pin may be disposed in the track of the clasp of the bracelet, and the length of the bracelet may be adjusted (e.g., shortened and/or lengthened) by moving the pin along a length of the track.

In some implementations, the clasp of the bracelet may include a member coupled to a cover of the clasp. The member may include one or more tracks. The track(s) may form first opening section(s) and second opening section(s) in the clasp. A height of the first opening section(s) may be less than the height of the second opening section(s). The first opening section(s) may form discrete adjustment points in the track. For example, a first length (e.g., for a bracelet) may be selected by disposing the pin of a link in a first first opening section and a second length may be selected by disposing the pin in a second first opening section.

The movement of the pin along a length of the track may be restricted, in some implementations. For example, the size of the pin may restrict the movement of the pin along the length of the track. The pin may have a cross-section and a length. The cross-section may have a height and at least one width (e.g., the width may vary along a height and/or the width may be approximately uniform along a height). The length of the pin may be greater than the width and/or the height of the cross-section. The width and the height of the cross-section may be less than the height of the first opening section(s) of the track. The width of the cross-section may be less than the height of the cross-section. The cross-section may have an approximately uniform or variable width and/or height along a length of the pin.

The pin may be rigidly coupled to the link such that when the link rotates, the pin rotates (e.g., as opposed to allowing the link to rotate about the pin as the pin maintains an orientation). Thus, the orientation of the pin and the cross-section height relative to the height of a track may change based on the orientation of the link. When the height of the cross-section of the pin relative to the track is less than the second opening section(s), the pin may be allowed to move along a length of the track. The height of the cross-section of the pin relative to the height of the track may be less than the second opening section(s) of the track when the link is oriented in a predetermined range of angles (e.g., slanted relative to the length of the track, approximately 5 degrees to approximately 185 degrees, approximately 30 degrees to approximately 60 degrees), in some implementations. When the height of the cross-section relative to the track height is greater than the second opening section(s), the pin may be restricted from moving along a length of the track. The height of the cross-section of the pin relative to the height of the track may be greater than the second opening section(s) and less than the first opening section(s) when the link is oriented approximately parallel to the length of the track, in some implementations.

In some implementations, other retaining members may restrict the adjustment of the length of the bracelet. For example, when rotation of the link is inhibited, the adjustment of the length of the bracelet may be inhibited. In some implementations, a lock coupled to an end of a bracelet and the clasp (e.g., a cover) may retain the articulating member (s) of a watch to the clasp and inhibit movement (e.g., rotation) of the link. The link may include one or more retaining members, such as spring-loaded buttons, spring-loaded pins, etc. The retaining members may couple with the cover of the clasp to retain the link approximately parallel to the length of the track. For example, opposing retaining members may be disposed on the link such that when the link is disposed parallel to the length of the track, the opposing retaining members engage the walls of the cover of the clasp to retain the link in a parallel position. The retaining members may be disengaged by exerting a force (e.g., greater than the force applied by the spring of the spring-loaded retaining member) on the link to rotate the link.

FIG. 1A illustrates a side view of an implementation of an example watch 100. Watch 100 may include bracelet 102 with first part 105 and second part 110. Bracelet 102 may at least partially wrap around a portion of a wearer's body, such as a wrist. First end 107, 112 of each part 105, 110 of bracelet 102 may be coupled to watch case 115 (e.g., via lugs of the watch case). Second end 108, 113 of each part 105, 110 of bracelet 102 may be coupled to clasp 120 of watch 100.

Clasp 120 may couple first part 105 and second part 110 of bracelet 102 together. Clasp 120 may include a closed position and an open position. Watch 100 may include lock 130 to retain clasp 120 in a closed position.

Figure 1B:
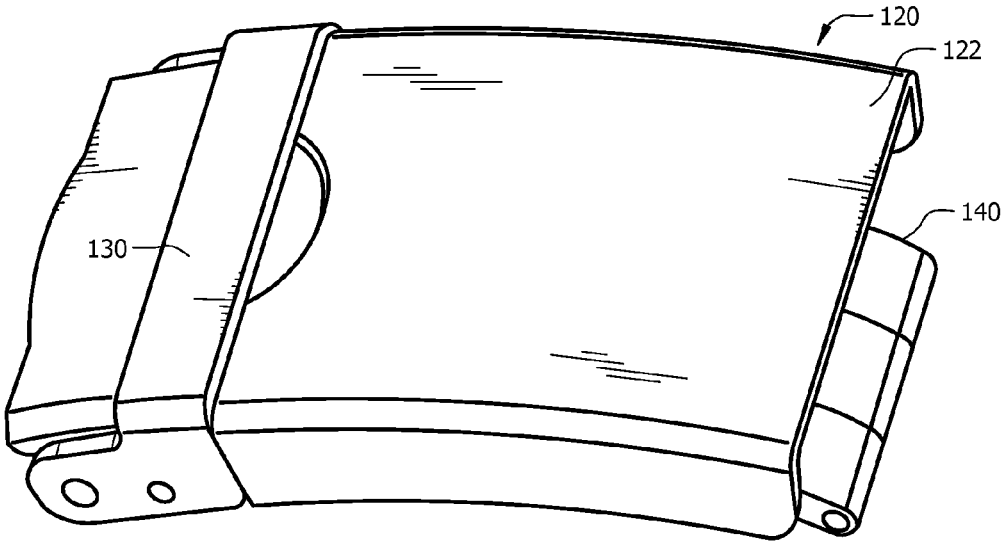
FIG. 1B illustrates a top view of a portion of a watch according to an embodiment of the present disclosure.
Figure 1C:
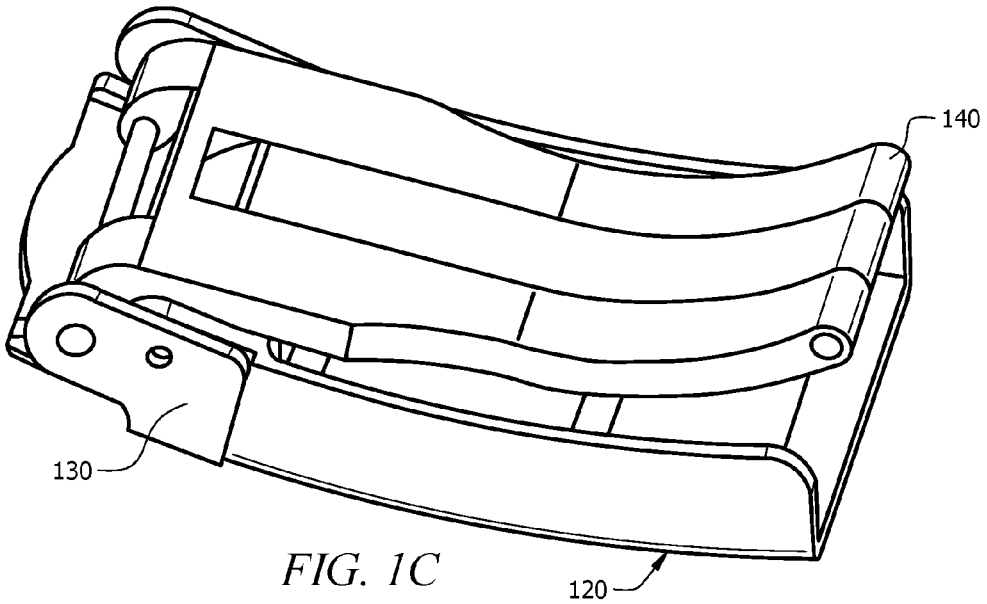
FIG. 1C illustrates a bottom view of the portion of the watch illustrated in FIG. 1B.

FIG. 1B illustrates a top view of a portion of watch 100 and FIG. 1C illustrates a bottom view of a portion of watch 100. As illustrated in FIGS. 1A-1C, clasp 120 is disposed in a closed position. Lock 130 may couple with cover 122 of clasp 120 to retain the clasp in a closed position. Articulating member(s) 142, 147 of the clasp may be at least partially coupled together (e.g., ends of the articulating members) and/or retained by lock 130 and/or clasp 120 in the closed position, in some implementations.

Figure 2A:
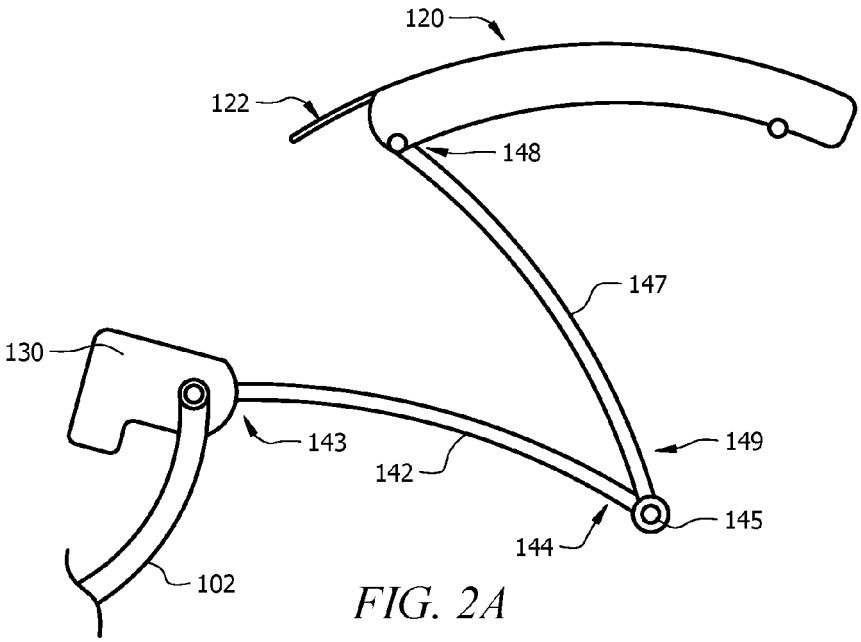
FIG. 2A illustrates an implementation of a portion of a watch according to an embodiment of the present disclosure in an open position.

FIG. 2A illustrates an implementation of a portion of an example watch in which clasp 120 is disposed in an open position. A clasp may include one or more articulating members 142, 147. The open position may allow the articulating members of the watch to rotate and/or increase the length of the watch (e.g., to facilitate putting the watch on and/or taking the watch off). For example, the clasp may be open to put on the watch, since by positioning the clasp in the open position, the articulating members may be released and allowed to rotate about the hinge. Thus, increasing the length of the watch and facilitating taking the watch off or putting the watch on.

As illustrated, clasp 120 includes first articulating member 142 and second articulating member 147 coupled via hinge 145. Hinge 145 may allow articulating members 142, 147 to rotate about hinge (e.g., a pin of the hinge), in some implementations. First end 143 of first articulating member 142 is coupled to lock 130 and/or an end of bracelet 102. First end 148 of second articulating member 147 may be coupled to cover 122 of clasp 120. Second end 144 of first articulating member 142 may be coupled to second end 149 of second articulating member 147 via hinge 145.

As illustrated, clasp 120 is in an open position. In the open position, the articulating members may be allowed to move (e.g., rotate about the hinge) and/or the cover of the clasp may be allowed to move away from lock 130. In the open position, the length of the bracelet of the watch may be greater than in the closed position (e.g., since the articulating members are not retained together as in the closed position). In some implementations, the articulating members may couple with cover 122 of clasp 120. For example, the articulating members may frictionally fit at least partially in a recess in the cover. In some implementations, lock 130 may be disposed such that it retains clasp 120 and/or articulating members 142, 147.

In various implementations, a length of the bracelet may be adjustable and/or readjustable. For example, a wearer may adjust the length of the bracelet to a first length and then later adjust the length of the bracelet to a second length, which may be less than or greater than the first length. Allowing variable lengths using the same bracelet may increase resale value (e.g., since the bracelet may fit a wider range of sizes), increase wearer comfort (e.g., since a length adjustment may be more fine tuned via the track when compared with removing and/or adding links of a bracelet), and/or accommodate wrist size changes (e.g., due to seasonal wrist dimension fluctuations, weight changes, etc.). The clasp may include a track that allows a length of the bracelet to be adjusted and/or readjusted. A length of the bracelet may be adjusted by moving a pin in a link of the bracelet (e.g., a link proximate second end 113 of second part of 110 of bracelet 102) along a track of the clasp.

Figure 2B:
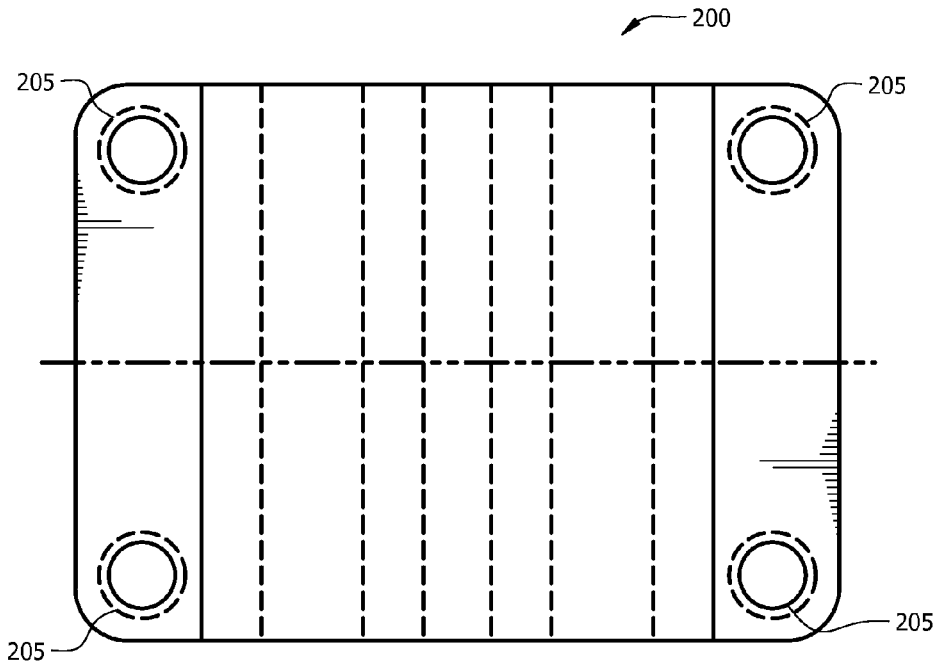
FIG. 2B illustrates a bottom view of a member according to an embodiment of the present disclosure that includes a track.
Figure 2C:
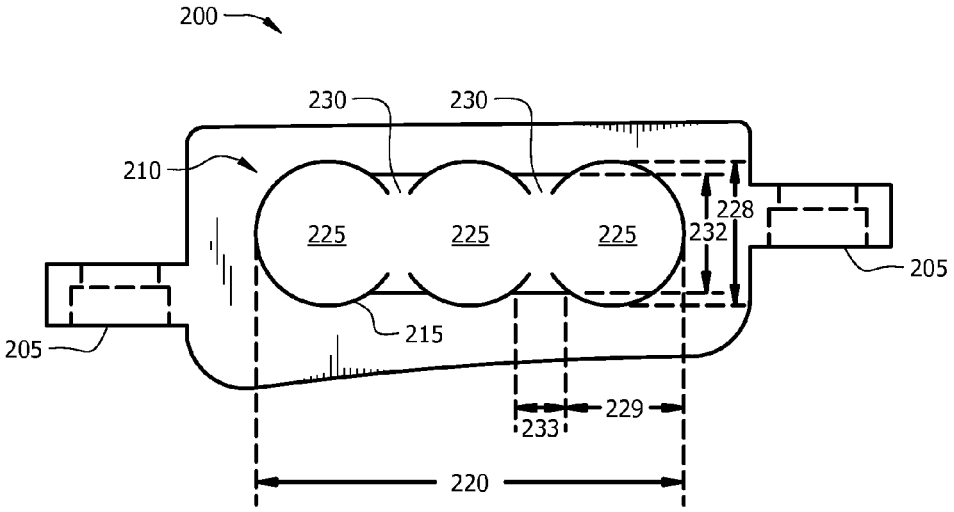
FIG. 2C illustrates a side view of the example member that includes a track illustrated in FIG. 2B.

Cover 122 of clasp 120 may at least partially cover the track (not shown). Clasp 120 may include a member in which the track is disposed. FIG. 2B illustrates a bottom view of an implementation of example member 200. FIG. 2C illustrates a side view of an implementation of example member 200 illustrated in FIG. 2B. Member 200 may be coupled to a bottom surface of the cover of a clasp. A top surface of the cover (e.g., cover 122 in FIG. 2A) may face outwards when a wearer wears the watch. Cover 122 may be the top surface of the clasp, in some implementations.

Member 200 may include one or more coupling members 205 to couple member 200 to the cover of the clasp. The dimensions (e.g., length, width, and height) of member 200 may be less than one or more of the dimensions (e.g., length, width, and height) of the cover of the clasp such that the member may be at least partially concealed.

The member may include one or more tracks formed in the member. The track may be adapted to receive and retain at least a portion of a link of the bracelet (e.g., a link on an end of the bracelet), the movement of which adjusts the length of the bracelet. Although the actual length of the part of the bracelet (e.g., second part 110) may not be adjusted, the length of the bracelet may be adjusted by adjusting the distance between the second ends (e.g., second ends 108, 113) of the parts (e.g., first part 105, second part 110) of the bracelet via the track.

As illustrated, member 200 includes single opening 210 through the member. Single opening 210 forms track 215 in the member. Track 215 may include length 220. Height 228 of track 215 may vary along length 220 of track 215. Track 215 may include first opening sections 225 and at least one second opening section 230. Height 232 of second opening section 230 may be less than height 228 of first opening section 225. In some implementations, a height of first opening sections 225 may vary (e.g., due to a curved or partially curved cross-sectional shape, as illustrated). Height 228 of first opening section 225 may be the maximum height of the first opening section, in some implementations.

The shape of first opening section 225 and/or second opening section 230 may be selected to receive a pin of a link retained in the track. For example, the curvature of a curved section of first opening section 225 may be the same as the curvature of a curved section of the pin.

Figure 3A:
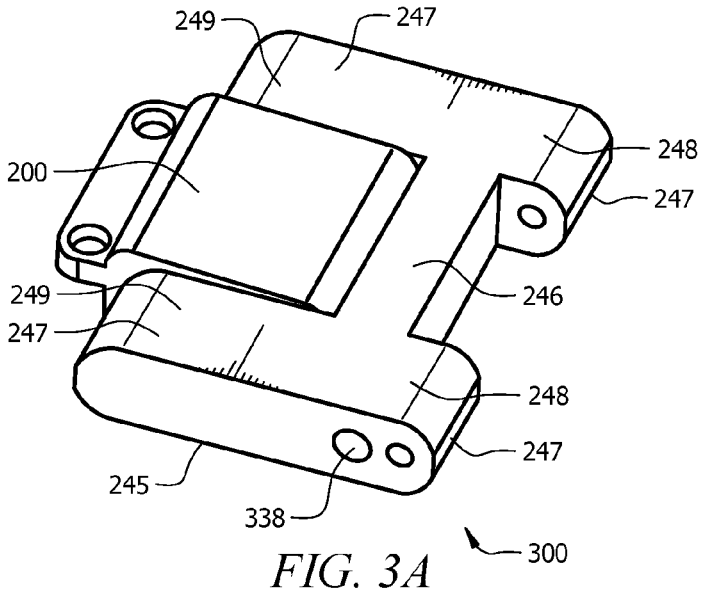
FIG. 3A illustrates an implementation of a portion of a watch according to an embodiment of the present disclosure with a link in a first position.
Figure 3B:
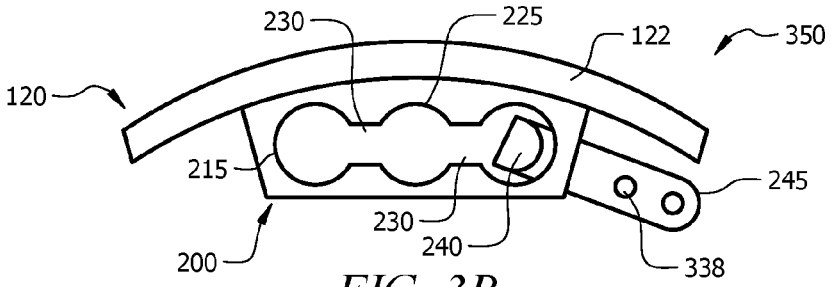
FIG. 3B illustrates the portion of an example watch illustrated in FIG. 3A with the link in a second position.
Figure 3C:
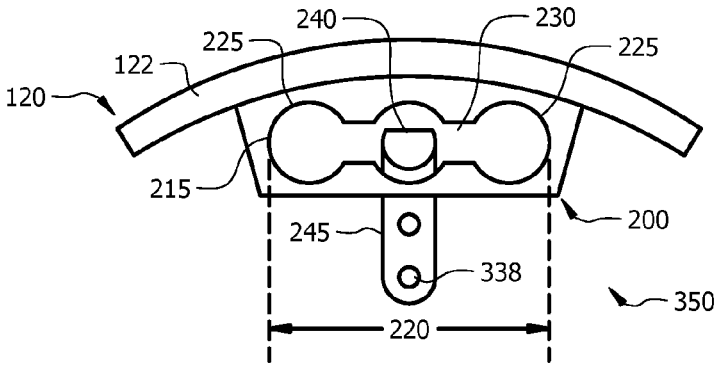
FIG. 3C illustrates a cross-sectional view of an implementation of a portion of a watch according to an embodiment of the present disclosure with a link in a second position.

FIG. 3A illustrates a perspective view of an implementation of example portion 300 that includes example member 200 and example link 245 of a bracelet. FIG. 3B illustrates a cross-sectional view of an implementation of example portion 350 that includes a portion of example clasp 120 with a track and example link 245 of a bracelet, in which the link is in a first position. FIG. 3C illustrates a cross-sectional view of an implementation of the example portion, illustrated in FIG. 3B, in which link 245 is in the second position.

As illustrated, track 215 includes a single opening through member 200 of clasp 120. Member 200 may be coupled to a bottom surface of cover 122 of clasp 120. Member 200 may be coupled proximate a center of cover 122 or in any other appropriate position. Track 215 may have length 220 and a cross-section in the plane perpendicular to the length. Track 215 may include a set (e.g., one or more) of first opening sections 225 and a set of second opening sections 230. First opening section 225 may include first height 228 and first width 229 (as shown in FIG. 2C). A second opening section may include a second height 232 and a second width 233 (as shown in FIG. 2C). First height 228 may be greater than second height 232. The shape of first opening section 225 and the shape of second opening section 230 in the cross-section may be different and/or similar.

The shapes and/or sizes of first opening section(s) 225 and second opening section(s) 230 may be selected such that pin 240 of link 245 in track 215 may be allowed to rotate in first opening section 225 and such that pin 240 may be restricted from rotating in second opening section 230. For example, first opening section 225 may have first height 228 and first width 229 that are greater than the height and the width of the cross-section of pin 240 of link 245.

Link 245 may be disposed proximate an end of the bracelet. For example, link 245 may be the first link from a second end of a second part of the bracelet (e.g., second end 113 of second part 110 of bracelet 102, in FIG. 1A). Link 245 may be coupled to other links, a leather band, a mesh band, and/or any other appropriate type of band.

Link 245 may be at least partially disposed in clasp 120. Link 245 may be at least partially disposed in cover 122 of clasp 120, in some implementations. For example, when clasp 120 is in the closed position and link 245 is oriented parallel to the length of the track, link 245 may be at least partially disposed in the cover, as depicted in FIG. 3B. A wearer may not be able to view a portion of link 245 when clasp 120 is closed, in some implementations.

As shown in FIG. 3A, link 245 may include body 246 and one or more arms 247. Pin 240 may be coupled to one or more of arms 247. As illustrated, link 245 may include an H-link with body 246 and four arms 247 extending from the body. Pin 240 may be coupled to two of the arms. Pin 240 may be disposed across two of arms 247. For example, pin 240 may reside between arm 248 and arm 249 proximate an end of arms 248, 249. In some implementations, link 245 may include arms 247 with an opening in which the pin is at least partially disposed.

Pin 240 may have a length and at least one cross-section in the plane perpendicular to the length. For example, the shape and/or size of the cross-section may vary and/or be the same across a length of the pin. The cross-section may vary to facilitate coupling the arms of the link and/or positioning in the track. The cross-section of pin 240 may have a curved portion and a straight portion, as illustrated in FIGS. 3B and 3C. For example, the cross-section of pin 240 may be c-shaped. Pin 240 may include solid and/or hollow portions.

The cross-section of pin 240 may have a height and at least one width. For example, the width may vary and/or be the same across the height of the pin. When a pin includes a c-shaped cross-section, the height of the pin may be the maximum height of the pin and the width of the pin may vary along the curve of the pin. The width(s) may be less than the height. The height of the pin may be less than the first height of the first opening section of the track. The height of the pin may be greater than the second height of the second opening section. The width of the pin may be less than the first height of the first opening section of the track and less than the second height of second opening section.

The pin may have a height relative to the height of the track. The height of the pin relative to the height of the track may be the dimension parallel to the height of the track. For example, as illustrated in FIG. 3B, pin 240 is shown in a first position and a pin height is the height relative to the height of the track. When pin 240 is in a second position, as illustrated in FIG. 3C, the width of the pin is the height relative to the height of the track.

As illustrated in FIG. 3B, when pin 240 is in the first position, link 245 may be disposed approximately parallel to the length of track 215 and/or cover 122 of clasp 120. When pin 240 is in the second position, as illustrated in FIG. 3C, link 245 may be disposed at a predetermined angle to the length of the track and/or cover of the clasp. The predetermined angle may be an angle selected between 0 and 180 degrees. For example, as illustrated in FIG. 3C, the predetermined angle may be approximately 90 degrees. Thus, when the link is approximately perpendicular to the track and/or the cover, the link may be in the second position. In some implementations, the predetermined angle may be an angle or range of angles selected from the range of 20 degrees to 60 degrees and/or 80 degrees to 100 degrees. Thus, the first position may be a position in which the link (e.g., a length of the link) is approximately parallel to the track and the second position may be an orientation of the link at an angle (e.g., slanted) relative to the orientation of the link disposed in the first position.

When link 245 is in the first position, the cross-section of the pin may be such that a plane parallel to the height of the pin may be perpendicular to the track and a plane parallel to the width of the pin may be parallel to the track. Thus, when link 245 is in the first position shown in FIG. 3B, pin 240 may be restricted from moving along a length of track 215 since the height of the pin may be greater than the height of second opening section 230.

When link 245 is in the second position, the cross-section of the pin may be such that a plane parallel to the height of the pin may be parallel to the track and a plane parallel to the width of the pin may be perpendicular to the track. Thus, when link 245 is in the second position shown in FIG. 3C, pin 240 may be allowed to move along a length of track 215 since the height of the pin may be less than the height of second opening section 230.

Figure 4A:
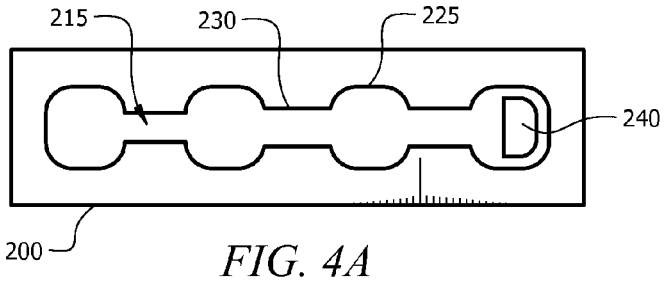
FIG. 4A illustrates a side view of an implementation of a track according to an embodiment of the present disclosure.
Figure 4B:
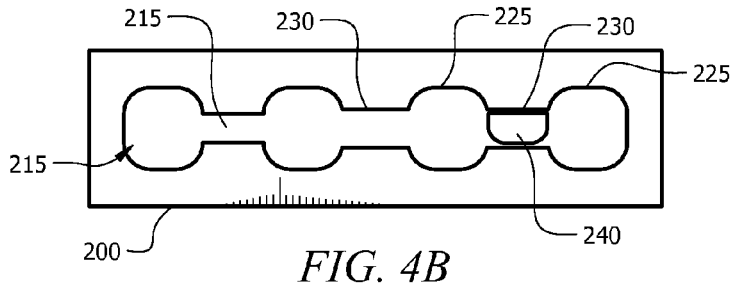
FIG. 4B illustrates a side view of an implementation of a track according to an embodiment of the present disclosure.

Although the positions (e.g., first position and second position of the pin) are illustrated as perpendicular to each other, other implementations may include other angles. FIG. 4A illustrates a cutaway view of a portion of track 215 and pin 240 when the link is in the first position. FIG. 4B illustrates a cutaway view of the portion of track 215 and pin 240 illustrated in FIG. 4A when the link is in the second position. As illustrated, the position of pin 240 may be associated with the position of the link. In the first position, pin 240 may be oriented such that a height of the pin is approximately perpendicular to the length of the track and/or the width of the pin is approximately parallel to the length of the track. This first position may be when the link is approximately parallel to the length of the track and/or other positions of the link, as appropriate. In the second position, the pin may be oriented such that a height of the pin is approximately parallel to the length of the track and/or the width of the pin is approximately perpendicular to the length of the track. This second position may be when the link is approximately perpendicular to the length of the track, at a slanted angle and/or other positions of the link that are different from the first position, as appropriate. The link, and thus pin 240, may be rotatable while in first opening sections 225. In some implementations (e.g., implementations without other retaining members such as a spring-loaded button), the link may rotate while pin 240 is in first opening sections 225, which may increase wearer comfort (e.g., since the link may rotate to lie more closely with the wearer's wrist rather than at a fixed angle). In some implementations, the link may not rotate in the first position when the other retaining members have engaged the cover. The link may be restricted from rotation while pin 240 is in second opening sections 230. For example, since the height of second opening section 230 may be less that the height of pin 240, pin 240 may be inhibited from rotating. Since the height of second opening section 230 is less than the height of first opening section 225, the link may be restricted from travelling along a length of track 215, and thus adjusting the length, unless pin 240 and/or link are in the second position.

In some implementations, the second position may be when the link is disposed slanted relative to the length of the track. In some implementations, the clasp and/or cover of the clasp may be curved and the link may be approximately parallel when the link resides in a predetermined parallel range of angles (e.g., approximately −10 degrees to approximately 10 degrees).

Referring again to FIGS. 3A-3C, in some implementations, link 245 may include other retaining members, such as spring-loaded buttons 338. As illustrated, the buttons may be disposed at least partially in a recess in link 245. The buttons may have any appropriate shape. In some implementations, a spring-loaded button may include a ball bearing coupled to and/or disposed proximate a spring. The spring and/or at least a portion of the ball bearing may be disposed in a recess of the link. When a force is applied to the ball bearing, the ball bearing may be refracted at least partially into the recess of the link. Thus, when the link is disposed parallel to the track and the cover, the buttons may be disposed proximate an inner surface of the cover. The cover may exert a force on the buttons to at least partially retract the buttons. The spring of the spring-loaded button may exert a force on the ball bearing to frictionally retain the ball bearing and thus the link to the cover of the clasp.

Figure 5:
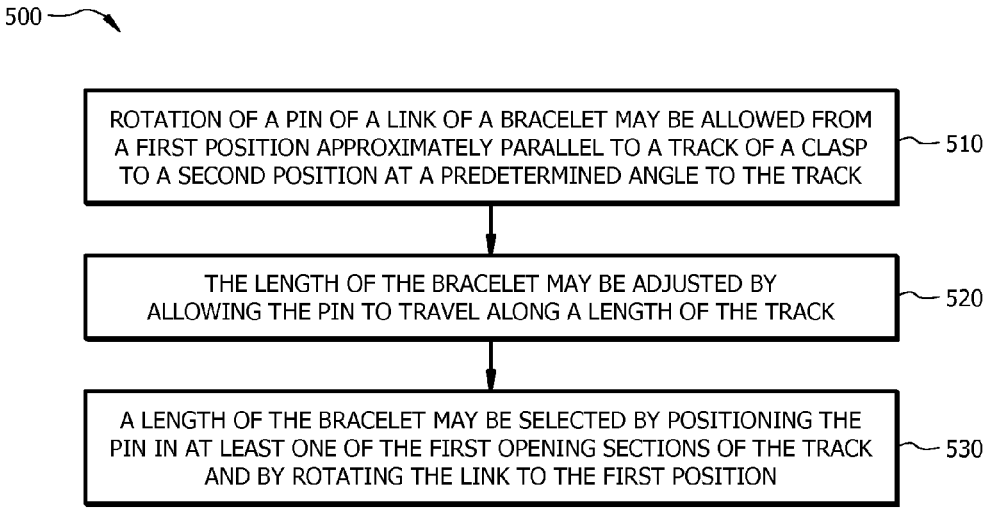
FIG. 5 illustrates a process for adjusting a watch according to an embodiment of the present disclosure.

FIG. 5 illustrates an implementation of example process 500 for adjusting a bracelet of a watch. A bracelet of a watch may include a clasp with a single track. The single track may be an opening in a member coupled to the bottom surface of the cover. A pin of the link proximate an end of the bracelet may be disposed in the track. The pin may be retained in the track.

Rotation of a pin of a link of a bracelet may be allowed from a first position approximately parallel to a track of a clasp to a second position at a predetermined angle to the track (operation 510). The pin may be disposed in the track.

The length of the bracelet may be adjusted by allowing the pin to travel along a length of the track (operation 520). For example, the pin may travel from at least one first opening section through at least one second opening section to another first opening section. The pin may be restricted from rotating when the link is in the second position and the pin is in at least one of the second opening sections.

A length of the bracelet may be selected by positioning the pin in at least one of the first opening sections of the track and by rotating the link to the first position (operation 530). The link may be allowed to rotate when the link is in the first position and/or the pin is in at least one of the first opening sections.

Process 500 may be implemented by various systems, such as system 100. In addition, various operations may be added, deleted, and/or modified. For example, allowing the pin to travel along the length of the track includes allowing the pin to travel through at least one of the second opening sections of the track. In some implementations, the pin may be restricted from traveling along a length of the track when the link is not in the second position. In some implementations, selecting a length of the bracelet may include allowing one or more spring-loaded buttons disposed in opposing sides of a link to be frictionally retained in a cover of the clasp.

In some implementations, adjusting the bracelet may include shortening and/or lengthening a length of a bracelet by allowing the pin to travel across a length of the track. In some implementations, a length of the bracelet may be readjusted. For example, the link may be adjusted such that the link is oriented in the second position. The pin may then be allowed to move along a length of a track from a first opening section to a second first opening section and/or through one or more second opening sections. Once the pin resides in the second first opening section, the link may be adjusted to be oriented in the first position.

In some implementations, orienting the link in the first position may include applying a force to the link such that the other retaining members of the link (e.g., spring loaded button) may couple with the cover (e.g., inner walls of the cover) of the clasp.

In some implementations, a bracelet may include a plurality of links, and one or more of the links may be removable to adjust the length of the bracelet. When links are removed and/or added to the bracelet, a length of the bracelet may be adjusted while maintaining the same distance between ends of the parts of the bracelet. When the track is used to adjust a length of the bracelet, the length of the bracelet may be adjusted by adjusting the distance between the ends of the parts of the bracelet.

Although FIGS. 1A through 4B illustrate implementations of watches, other implementations may be utilized. For example, a bracelet may include a single part and the watch case may couple to a portion between two second ends 108, 113 of the bracelet. In some implementations, the watch may not include a lock. For example, the watch may include two or more articulating members that are frictionally retained in the clasp when the clasp is in the closed position.

Although bracelets in watches have been described, the described bracelets may be utilized in jewelry, in various implementations. For example, a bangle may include a clasp with a track that allows adjustment of the length of the bracelet (e.g., the bangle) as described. Thus, a bangle size may be adjusted without cutting and rejoining the bangle.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a pin" includes a combination of two or more pins and reference to "an opening" includes different types and/or combinations of openings.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A watch comprising:

a watch case comprising a movement;

a bracelet coupled to the watch case, the bracelet comprising:

a clasp coupled proximate a first end of the bracelet, wherein the clasp comprises:

a track comprising an opening disposed in a member of the clasp, wherein the opening comprises a set of first opening sections coupled together by a set of second opening sections, wherein a height of the second opening sections is less than a height of the first opening sections; and a link coupled proximate a second end of the bracelet, wherein the link comprises a pin, and wherein the pin comprises:

a length; and a cross-section perpendicular to the length, wherein the cross-section of the pin comprises a width and a height, and wherein the width of the cross-section is less than the height of the cross-section;

wherein the pin of the link is disposed in the track, and wherein the link is rotatable when the pin is disposed in one of the first openings; and wherein the link is restricted from rotating when the pin is disposed in one of the second openings; and wherein a length of the bracelet is adjustable by allowing the pin of the link to travel along a length of the track, wherein the pin is restricted from travel along the length of the track when the link is approximately parallel to the track.

2. The watch of claim 1, wherein the link comprises an H-link.

3. The watch of claim 1, further comprising at least two spring-loaded buttons, wherein at least two of the buttons are disposed on opposing sides of the link, and wherein the buttons are adapted to allow frictional retention of the link in a cover of the clasp when the link is approximately parallel to the track.

4. The watch of claim 1, wherein the cross-section comprises a curved section and a straight section.

5. The watch of claim 1, wherein the clasp comprises at least two articulating members comprising:

a first articulating member; and a second articulating member;

wherein a first end of the second articulating member is coupled to a first end of the first articulating member, and a second end of the first articulating member is coupled to a second end of the bracelet, and wherein the second end of the second articulating member is coupled to the cover of the clasp.

6. The watch of claim 1, further comprising:

a lock, wherein the lock is adapted to retain the clasp in a closed position when coupled to a cover of the clasp.

7. The watch of claim 1, wherein the bracelet comprises:

a first part comprising:

a first end comprising the first end of the bracelet; and a second end coupled to a first end of the watch case; and a second part comprising:

a first end comprising the second end of the bracelet; and a second end coupled to a second end of the watch case opposite to the first end of the watch case.

8. The watch of claim 1, wherein the bracelet comprises one or more removable links.

9. A bracelet comprising:

a clasp coupled proximate a first end of a bracelet, wherein the clasp comprises:

a track, wherein the track comprises an opening disposed in a member of the clasp, wherein the opening comprises a set of first openings coupled together by a set of second openings, wherein the height of the second openings is less than the height of the first openings;

a link coupled proximate a second end of the bracelet, wherein the link comprises a pin, and wherein the pin comprises:

a length; and a cross-sectional shape perpendicular to the length, and wherein the cross-sectional shape of the pin comprises a width and a height, and wherein the width of the cross-sectional shape is less than the height of the cross-sectional shape;

wherein the pin of the link is disposed in the track, and wherein the link is rotatable when the pin is disposed in one of the first openings; and wherein the link is restricted from rotating when the pin is disposed in one of the second openings; and wherein a length of the bracelet is adjusted by allowing the pin to travel along a length of a track, and wherein a length of the bracelet is restricted from adjusting when the link is approximately parallel to the length of the track.

10. The bracelet of claim 9, wherein the cross-sectional shape comprises a curved section and a straight section.

11. The bracelet of claim 9, wherein the pin is retained in the track.

12. The bracelet of claim 9, wherein the bracelet is adapted to couple to a watch case.

13. The bracelet of claim 9, further comprising at least two spring loaded buttons, wherein at least two of the buttons are disposed on opposing sides of the link, and wherein the buttons are adapted to allow frictional retention of the link in a cover of the clasp when the link is approximately parallel to the track.

14. The bracelet of claim 9, wherein the bracelet comprises a second end, and wherein the clasp comprises at least two articulating members comprising:

a first arm; and a second arm;

wherein a first end of the second arm is coupled to a first end of the first arm, and a second end of the first arm is coupled to a second end of the bracelet, and wherein the second end of the second arm is coupled to a cover of the clasp.

15. The bracelet of claim 9 further comprising:

a lock adapted to retain the clasp in a closed position.

* * * * *